US005493365A

United States Patent [19]

Matsui et al.

[11] Patent Number: 5,493,365

[45] Date of Patent: Feb. 20, 1996

[54] OPERATING SECTION FOR AN IMAGE FORMING APPARATUS

[75] Inventors: Hideaki Matsui, Yokohama; Nobuaki Tomidokoro, Sagamihara; Shigeru Yoshiki, Kawasaki; Shigeru Watanabe, Yokohama; Shinichi Kawahara, Tokyo; Yasuhiro Kawashima, Atsugi; Katsuhiro Echigo, Asaka; Makoto Obu, Yokohama; Fumio Kishi, Yokohama; Hidetoshi Yano; Yasuo Kawada, Kawasaki; Hidenori Sakai, Hiratsuka, all of Japan

[73] Assignee: Ricoh Company, Ltd., Tokyo, Japan

[21] Appl. No.: 265,212

[22] Filed: Jun. 24, 1994

[30] Foreign Application Priority Data

Jun. 25, 1993 [JP] Japan ..... 5-155696
Sep. 28, 1993 [JP] Japan ..... 5-241199

[51] Int. Cl.[6] ..... G03G 21/00

[52] U.S. Cl. ..... 355/202; 355/204

[58] Field of Search ..... 355/200, 202, 355/204, 206, 208, 209

[56] References Cited

U.S. PATENT DOCUMENTS

| | | | |
|---|---|---|---|
| 4,887,129 | 12/1989 | Shenoy et al. | 355/202 X |
| 4,963,932 | 10/1990 | Horvath | 355/202 X |
| 5,027,153 | 6/1991 | Somiya | 355/200 |
| 5,091,746 | 2/1992 | Watanabe | 355/202 |
| 5,212,519 | 5/1993 | Kasahra et al. | 355/200 |
| 5,325,152 | 6/1994 | Higashio et al. | 355/202 |
| 5,343,275 | 8/1994 | Sulenski | 355/202 |

*Primary Examiner*—Sandra L. Brase
*Attorney, Agent, or Firm*—Oblon, Spivak, McClelland, Maier & Neustadt

[57] ABSTRACT

In an image forming apparatus, an operating section accessible for entering various information and commands is implemented as a plurality of key units. The key units are each removably connected to the body of the operating section via cooperative connectors. When any one of the key units is damaged or or the life thereof expires, only the defective unit is replaced while the other units are continuously used.

20 Claims, 7 Drawing Sheets

OPERATING SECTION FOR AN IMAGE FORMING APPARATUS

BACKGROUND OF THE INVENTION

The present invention relates to a copier, facsimile apparatus, printer or similar image forming apparatus and, more particularly, to an operating section accessible for entering information and commands meant for the image forming apparatus.

Today, the protection of environment and resource saving are one of major issues needing immediate solution. Even the equipment for office automation are required to meet such demands. Regarding copiers, facsimile apparatuses and printers, which are typical office automation equipment, recycling the entire or part of the apparatuses has been studied as an implementation for saving limited resources. Specifically, this kind of apparatus includes many parts made of resin and metal and even expensive electric parts and is considered to need a high degree of recycling. For example, an operating section included in the image forming apparatus is provided with various kinds of keys for entering commands meant for the apparatus, display means, and a circuit board on which control means for controlling the keys and display means, storing means and other electronic parts are packaged. Hence, reusing the operating section, which is expensive, is desirable from the cost standpoint as well as from the resource standpoint. Usually, the operating section has a body and display means, one-touch keys, numeral keys, start key, extra function keys and other conventional keys which are arranged on the body to constitute a single unit.

The number of functions available with the image forming apparatus and, therefore, the number of input keys on the operating section is increasing, complicating the manipulation of the operating section. A copier, for example, has a simple copying function, or basic function, and additional functions including a magnification changing function and editing function. The frequency of use of the basic function and that of the additional functions greatly differ from each other, depending on the user. It follows that the frequency of use noticeably differs from one input key to another input key. Therefore, it is likely that the life of some keys expires due to frequent use when the other keys, which are rarely used, sufficiently stand further operation.

The problem with the conventional operating section is that it is entirely constructed into a single unit, as stated earlier. Even when only part of keys or part of indicators is damaged or their life expires, the operating section has to be bodily replaced with another.

SUMMARY OF THE INVENTION

It is, therefore, an object of the present invention to provide an operating section for an image forming apparatus which does not have to be bodily replaced when part of keys or part of indicators is damaged or their life expires.

It is another object of the present invention to provide an operating section for an image forming apparatus which is removable from the body of the apparatus to be reused.

An operating section for an image forming apparatus of the present invention comprises a body, and at least one of an inputting device accessible for inputting commands meant for the image forming apparatus, and a display for displaying statuses of the image forming apparatus and other necessary information. The at least one of the inputting device and display is at least partly constructed into a unit which is removable from the body.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 13:
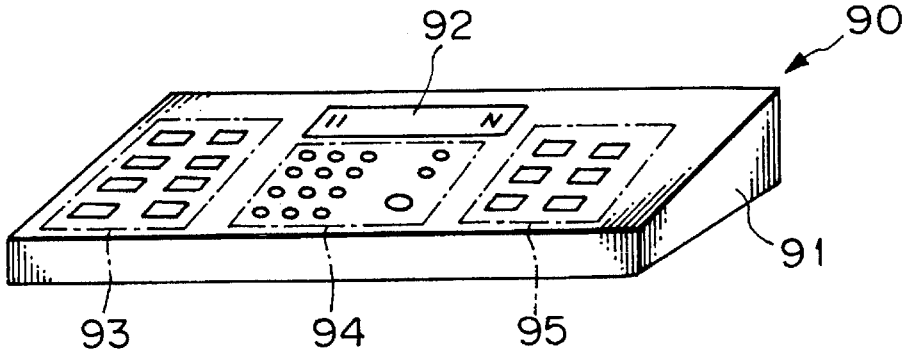
Fig. 13 PRIOR ART
FIG. 13 is a perspective view of a conventional operating section.

To better understand the present invention, a brief reference will be made to a conventional operating section included in an image forming apparatus, shown in FIG. 13. As shown, the operating section, generally 90, has a body 91. Display means 92, one-touch keys 93, a start key and numeral keys 94 and extra function keys 95, as well as other conventional keys, are arranged on the body 91 as a single unit. The problem with this configuration is that the operating section 90 has to be bodily replaced even when only part of the keys or part of indicators is damaged or or their life expires, as discussed earlier.

Preferred embodiments of the operating section for an image forming apparatus in accordance with the present invention will be described which are free from the problem stated above.

Figure 1:
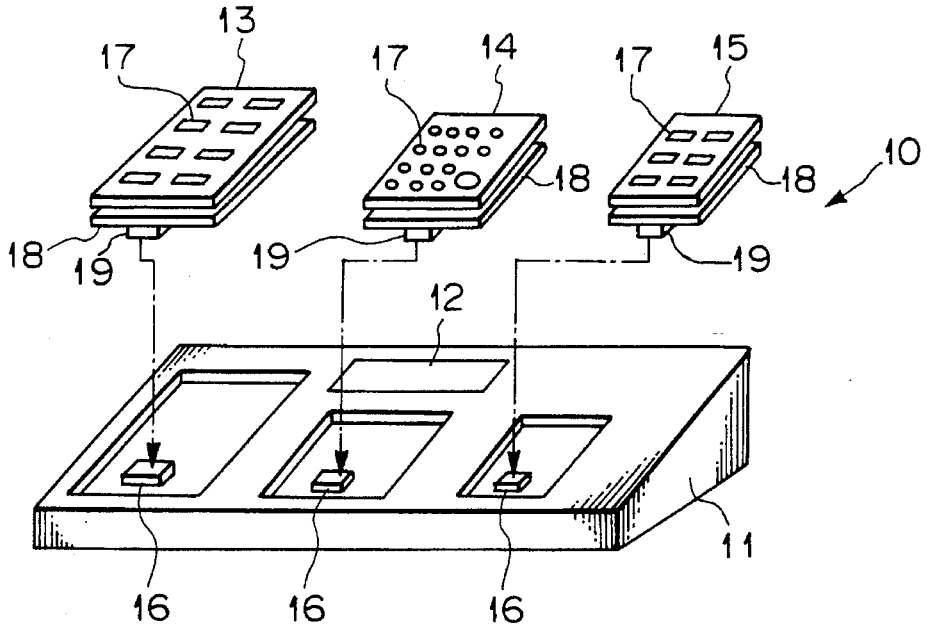
FIGS. 1 and 2 are perspective views respectively showing a first and a second embodiment of the operating section in accordance with the present invention.

Referring to FIG. 1, a first embodiment of the present invention is shown. As shown, an operating section, generally 10, is physically separate from the body of an image forming apparatus and removably mounted to the body. The operating section 10 is made up of a body 11 and three independent key units, i.e., a one-touch key unit 13, a start key and numeral key unit 14, and an extra function key unit 15. The key units 13–15 each has a key top 17 having input keys and a cover covering them, a printed wiring board (PWB) 18 for transferring key inputs, and a connector 19 for connecting the key unit to the body 11. Provided on the frame 11 are a display panel 12 and connectors 16 to mate with the connectors 19 of the key units 13–15. The key units 13–15 and the body 11 are physically connected by the connectors 19 and 16 and, at the same time, electrically connected to each other. Key inputs from the key units 13–15 are delivered to the body 11 and further to the apparatus body via connectors, not shown, which connect the body 11 to the apparatus body.

In the illustrative embodiment, various keys are arranged on three independent key units 13–15 while the key units 13–15 are each removably mounted on the body 11. Hence, when any one of the key units 13–15 is smeared or damaged or the life thereof expires, it should only be replaced alone. This makes it needless to replace the entire operating section 10 and allows the other key units and body 11 to be continuously used. Further, when the body 11 is damaged or the life thereof expires while the key units 13–15 are still usable, replacing only the body 11 suffices.

The keys of the operating section 10 are classified on a function basis and arranged on the respective key units 13–15. Such a key arrangement promotes easy manipulation. In addition, since keys comparable with each other as to the frequency of use are collectively arranged on a single unit, they wear evenly, promoting the effective use of the unit. For example, if the start key which is frequently used and the extra function keys which are rarely used are positioned on a single unit, it is likely that the life of the start key expires while the extra keys sufficiently stand further operation. Then, such a unit has to be bodily replaced despite that the extra function keys are still usable.

Of course, the number of key units and the allocation of the keys to the key units shown and described are only illustrative. If desired, only the start key included in the start key and numeral key unit 14 may be provided on another key unit, or all the input keys may be arranged on a single key unit.

Figure 2:
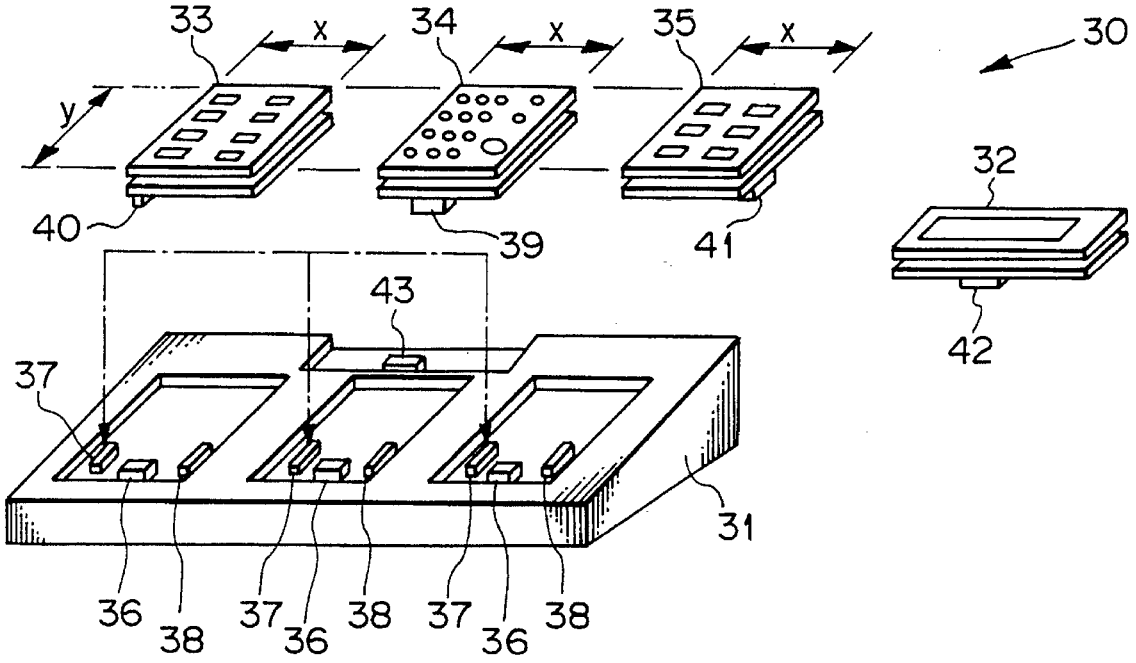

FIG. 2 shows a second embodiment of the present invention. As shown, an operating section 30 has a body 31, a display unit 32, and three key units, i.e., a one-touch key unit 33, a start key and numeral key unit 34, and an extra function key unit 35. All the three key units 33–35 have the same horizontal and vertical dimensions X and Y, respectively. The key units 33–35 are respectively provided with connectors 39, 40 and 41 to be connected to the body 31. Although the connectors 39–41 are identical in configuration, they are different from each other as to the position on the key unit. Specifically, the connector 40 is positioned at the front left of the key unit 33, the connector 39 is positioned at the front center of the key unit 34, and the connector 41 is positioned at the front right of the key unit 35.

On the other hand, three connectors 36, 37 and 38 are provided on the body 31 at each of three positions corresponding to the key units 33–35. In this configuration, despite that the connectors 39–41 of the key units 33–35 are different in position from each other, the key units 33–35, having the same dimensions, can each be mounted to any one of the three positions available on the body 31. The kind of the key unit connected to any one of the connectors 36–38 can be determined on the basis of the position of the connector. Specifically, the key units connected to the connectors 37, 36 and 38 are determined to be the one-touch key unit 33, start key and numeral key unit 34, and extra function key unit 35, respectively. The display unit 32 has a connector 42 while the body 31 has a connector 34 to mate with the connector 42.

The operating section 30 having the above construction allows the three key units 33–35 to be arranged on the body 31 in any desired layout which is convenient to use. Since the kind of each key unit can be determined based on the position of the connector, the control over the key units 33–35 is facilitated. Furthermore, since the display means 32 is removably mounted on the body 31 as a single unit, it can be reused or, when damaged, replaced in the same manner as the other units.

All the key units 33–35 have been shown and described as having the same shape and dimensions. Alternatively, if the recesses formed on the top of the body 31 for receiving the key units 33–35 are replaced with a simple flat surface, the key units 33–35 may each be provided with a particular shape and dimensions so as to be located at a desired position on the body 31.

A third embodiment of the present invention will be described hereinafter. In this embodiment, a plurality of key units, not shown, mounted on an operating section, not shown, are provided with connectors of the same configuration at the same position. A single connector is located on a body, not shown, at positions respectively corresponding to the plurality of key units. A particular identification (ID) code is given to each of the key units and a display unit. A CPU (Central Processing Unit), built in the body, reads the ID codes to determine the kinds of the key units and display unit. The embodiment, therefore, can identify the individual units without resorting to a plurality of connectors which the second embodiment, i.e., operating section 30 has at each unit mounting position thereof. As a result, the number of connectors and, therefore, the cost is reduced. Moreover, when any one of the units is replaced due to the addition of an extra function, the CPU is capable of controlling a new unit accurately by identifying the kind of the new unit.

Figure 3:
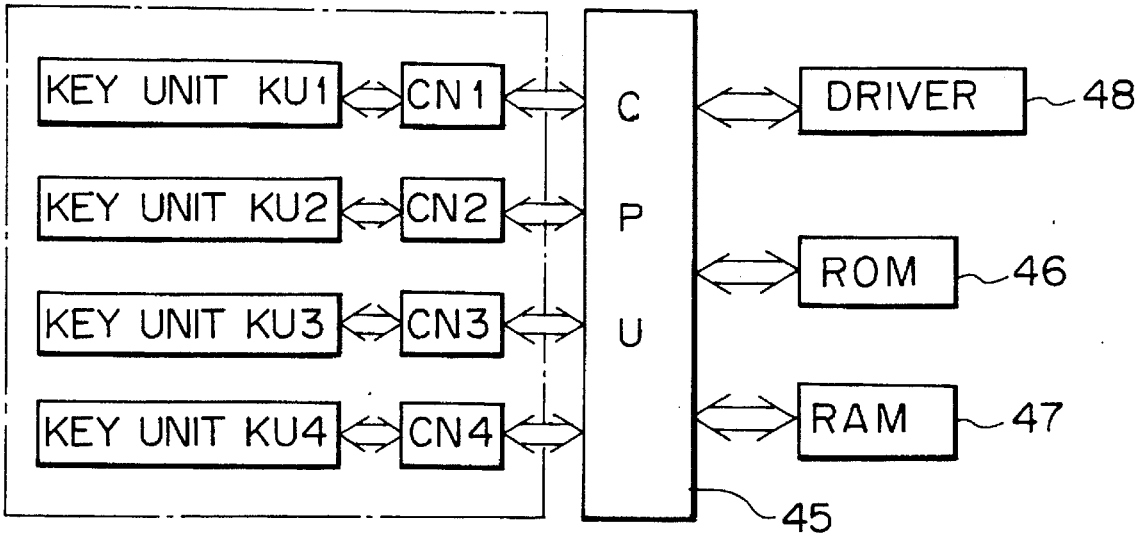
FIG. 3 is a block diagram schematically showing a control system associated with a third embodiment of the present invention.

FIG. 3 shows a system for controlling the operating section, labeled 30A, in accordance with the third embodiment. As shown, key units KU1–KU3 and a display unit are controlled by a CPU 45. For example, the inputs from the key units KU1–KU3 are transferred to the CPU 45 via connectors CN1–CN3, respectively. In response, the CPU 45 displays information on the display unit or controls a driver 48 on the basis of a control program stored in a ROM (Read Only Memory) 46 and a RAM (Random Access Memory).

Figure 4:
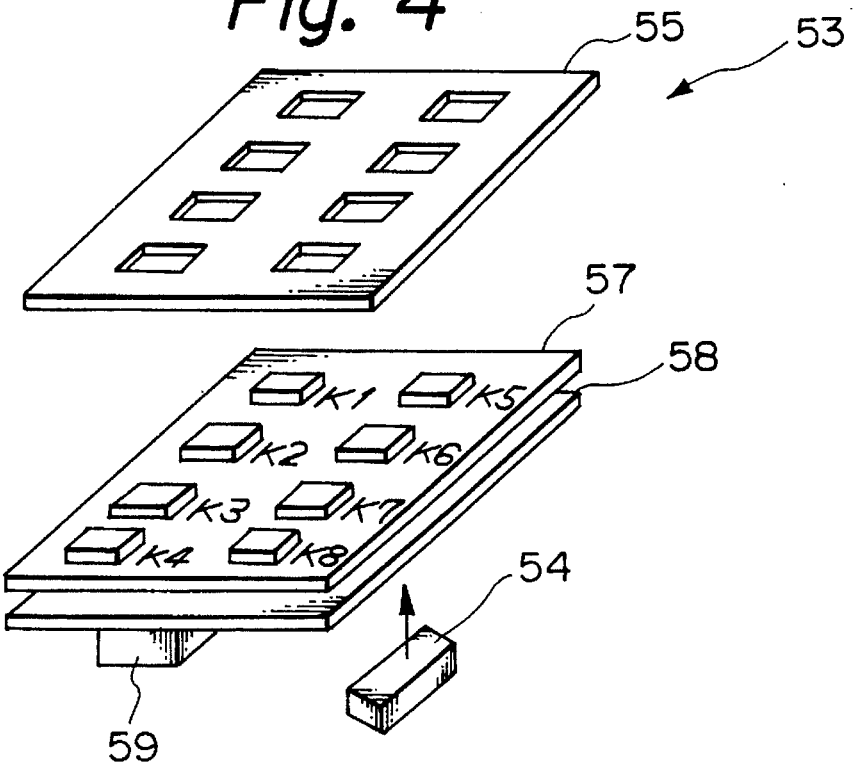
FIG. 4 is a perspective view of a one-touch key unit representative of a fourth embodiment of the present invention.

A fourth embodiment of the present invention will be described which is implemented as an operating section for a facsimile apparatus. The operating section includes a key unit having storing means for storing input information. FIG. 4 shows a one-touch key unit 53 having one-touch keys, customary with conventional facsimile apparatuses, constructed into a single unit. As shown, the key unit 53 has a key top 57 made up of input keys and a cover covering them, a printed wiring board 58, and a connector 59. A memory, e.g., nonvolatile RAM 54 is mounted on the wiring board 58. A label sheet 55 is put on the key top 57.

In the illustrative embodiment, the user can store the telephone numbers or facsimile numbers of, for example, persons to communicate frequently in the memory 54 of the key unit 53 and assign each number to a particular one-touch key. For example, assume that the user assigns the facsimile number of a certain person to a single-touch key K1. Then, only if the user presses the key K1, a communication meant for the other party will start automatically. This makes it needless for the user to enter the facsimile number of the desired person on the operating section.

As stated above, the embodiment allows the telephone numbers or facsimile numbers of addressees to be stored in the memory 54 of the one-touch key unit 53. Hence, even when the body of the operating section is replaced, the key unit 53 can be continuously used, i.e., it is not necessary for the user to enter the telephone numbers or facsimile numbers of addressees on the single-touch keys K1–K8 all over again. Also, the label sheet 55 can be continuously used and does not have to be rewritten. In addition, even when the type of machine is changed, the key unit 53 can be used with a new machine only if the configuration of a connector on the body of the operating section is the same. This also makes it needless to reenter or rewrite the telephone numbers or facsimile numbers.

It should be noted that the telephone numbers or facsimile numbers written to the memory 54 of the one-touch key unit 53 are only illustrative. In a copier, for example, a complicated function setting procedure using a plurality of keys may be written to the memory 54. Then, such a procedure will be effected only if a particular one-touch key is pressed once.

Figure 5:
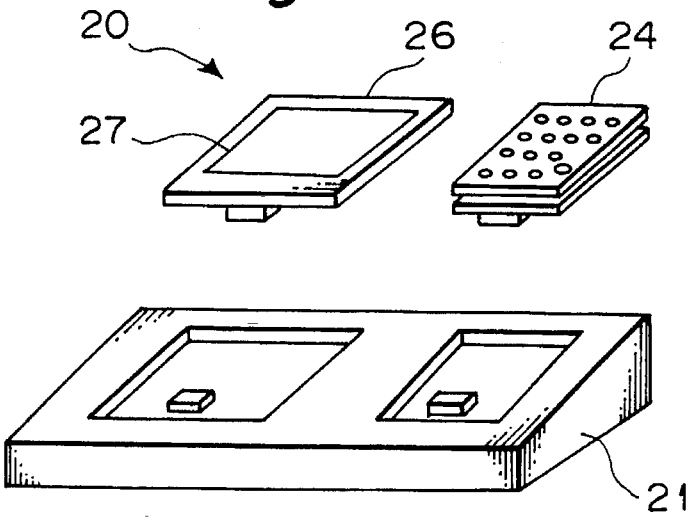
FIGS. 5 and 6 are perspective views respectively showing a fifth and a sixth embodiment of the present invention.

Referring to FIG. 5, a fifth embodiment of the present invention is shown. As shown, an operating section 20 has a body 21, and a touch panel unit 26 and a start key and numeral key unit 24 which are removably mounted on the body 21. The touch panel unit 26 has a touch panel 27 implemented by inputting means responsive to a touch and a liquid crystal display or similar display means. The inputting means and display means are laid one upon the other. The start key and numeral key unit 24 includes conventional input keys to be pressed. The touch panel unit 26, which is expensive, is removable from the body 21 and, therefore, feasible for the reuse scheme. In addition, when the touch panel 27 is deteriorated, only the touch panel unit 26 has to be replaced.

Figure 6:
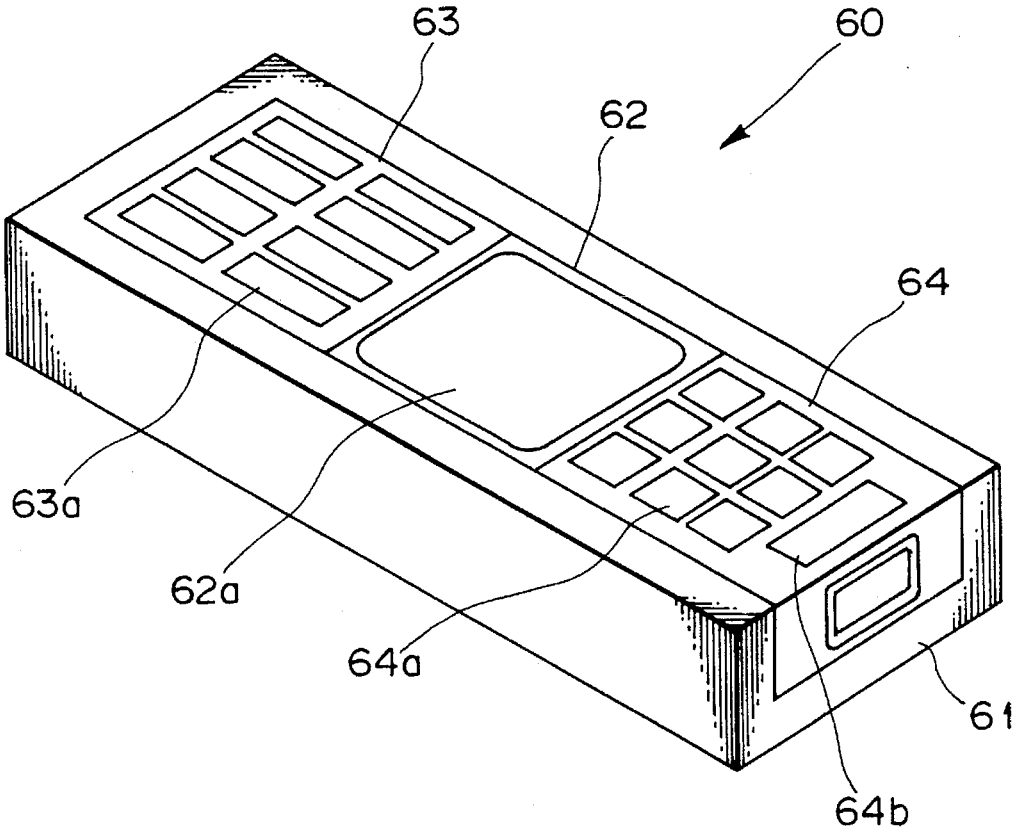

FIG. 6 shows a sixth embodiment of the present invention. As shown, an operating section 60 has a body 61, a display unit 62, a one-touch key unit 63, and a numeral key unit 64. The one-touch key unit 63 has command keys **63*a* and is accessible for selecting a magnification changing function, editing function, duplex copying function, etc. The display unit 62 has a display 62*a* for displaying various statuses of the apparatus. Further, the numeral key unit 64 has numeral keys 64*a* and a start button 64*b*** and is operated to enter a desired number of copies and other information.

Figure 7:
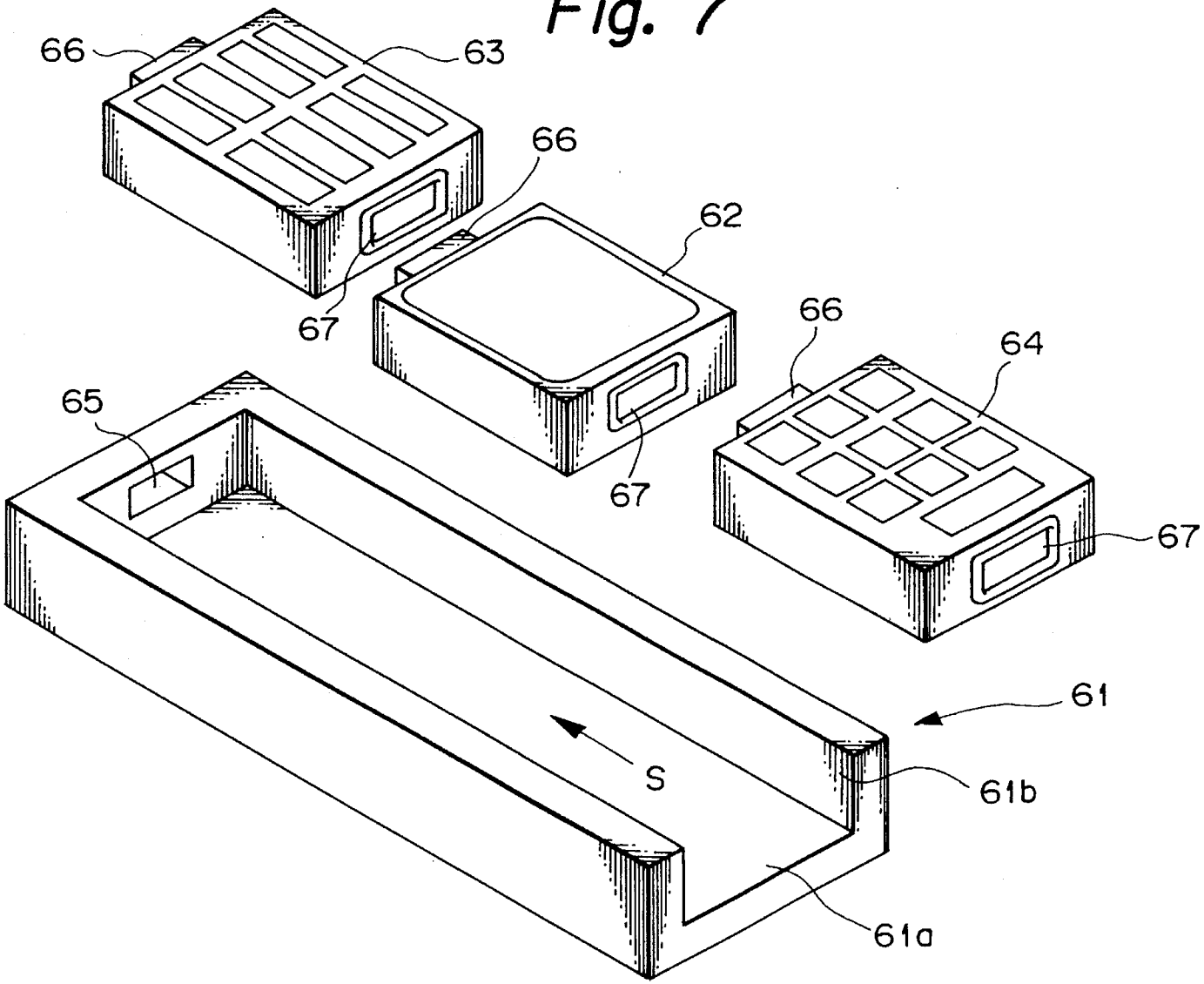
FIG. 7 is an exploded perspective view of the sixth embodiment.

As shown in FIG. 7, the body 61 of the illustrative embodiment has a unit mounting surface **61*a* and upright walls 61*b* extending from three sides of the surface 61*a*. A connector 65 is provided on, among the three side walls 61*b*, the side wall 21*b* extending along the short side of the surface 61*a*. The three units 62–64 are each provided with connectors 66 and 67 in the form of projections and recesses, respectively. The connectors, or projections, 66 of the units 62–64 have an identical configuration and can each mate with the connector 65 of the body 61. The connectors, or recesses, 67 are also identical in configuration with each other and with the connector 65 of the body 61. Hence, the connector 66 of each unit can mate not only with the connector 65 of the body 61 but also with the connector 67** of another unit.

To set the units 62–64 on the body 61, the first unit is put on the mounting surface **61*a* and then pushed in a direction S, FIG. 7, until the connector 66 thereof mates with the connector 65. Then, the second unit is laid on the mounting surface 61*a* and then pushed in the same direction S until the connector 66 thereof mates with the connector 67 of the first unit. The third unit is set in the same manner as the second unit. The connectors 66 and 67 connect the units 62–64 physically and electrically. The first unit is connected to the body 61 physically and electrically by the connector 66 mating with the connector 65. In this configuration, not only the first unit but also the second and third units are electrically connected to the body 61 and, therefore, capable of communicating with the body 61. The units 62–64 will be removed from the body 61** if the above procedure is executed in the reverse order.

The connectors 66 and the connectors 67 of the units 62–64 each has an identical shape, as stated above. Hence, the units 62–64 can be set on the body 61 in any desired order. While the one-touch key unit 63, display unit 62 and numeral key unit 64 are shown in FIG. 6 as being mounted to the body 61 in this order, the numeral key unit 64, for example, may be located at the left or the center, or the display unit 62 may be positioned at the left or the right.

Figure 8:
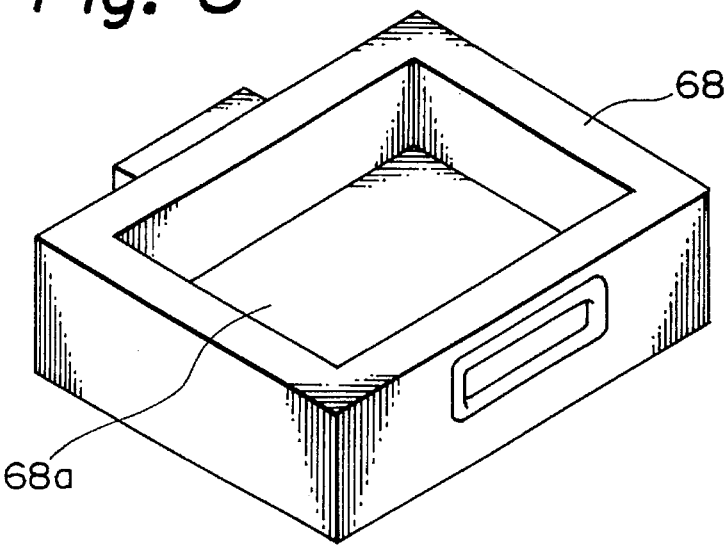
FIG. 8 is a perspective view of a dummy block which may be mounted to the operating section shown in FIG. 6.

Assume that the image forming apparatus lacks special functions including a magnification changing function and a duplex copying function. Then, a dummy block 68 shown in FIG. 8 may be mounted to the body 61 in place of the one-touch key unit 63. Clips and staples may be put in the dummy block 68.

Figure 9:
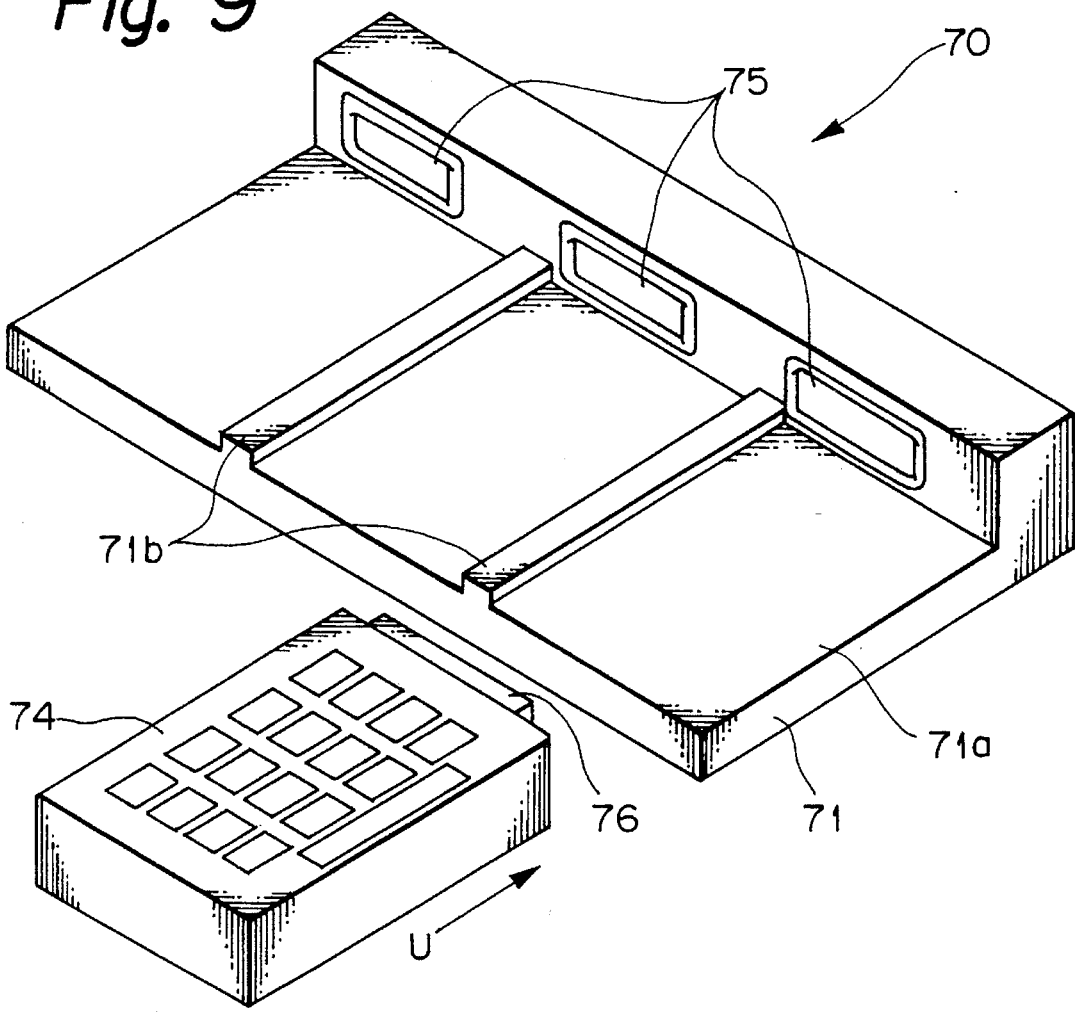
FIG. 9 is a perspective view showing a seventh embodiment of the present invention.

Referring to FIG. 9, a seventh embodiment of the present invention will be described. As shown, an operating section 70 has a body 71. The body 71 has a unit mounting surface **71*a* which is divided into three portions by guide rails 71*b*. A connector 75 is provided on each of the three portions of the surface 71*a*. In this embodiment, a numeral key unit 74 has only a connector 76 in the form of a projection on one end thereof. A one-touch key unit and a display unit are also provided with such a connector 76, although not shown in the figure. To mount the units to the body 71, they are each put on the surface 71*a* of the body 71 and then pushed in a direction U until the connector 76 thereof mates with the associated connector 75. In this condition, the unit is connected to the body 71** physically and electrically.

In this embodiment, the three connectors 75 of the body 71 and the connectors 76 of the units each has an identical configuration. It follows that the units can be replaced with each other in a desired arrangement.

An eighth embodiment of the present invention, which will be described hereinafter, is identical with the sixth embodiment (FIGS. 6 and 7) except that it additionally includes a mechanism for preventing the units from being mounted or dismounted. The following description will concentrate on the portions of the eighth embodiment which are different from the sixth embodiment.

Figure 10:
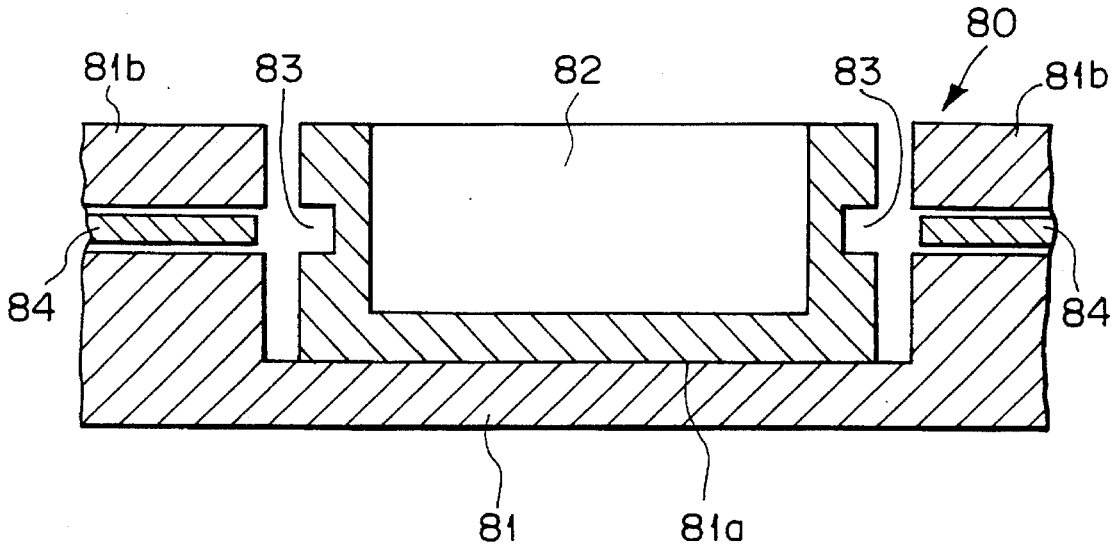
FIG. 10 is a fragmentary section showing an eighth embodiment of the present invention.
Figure 11:
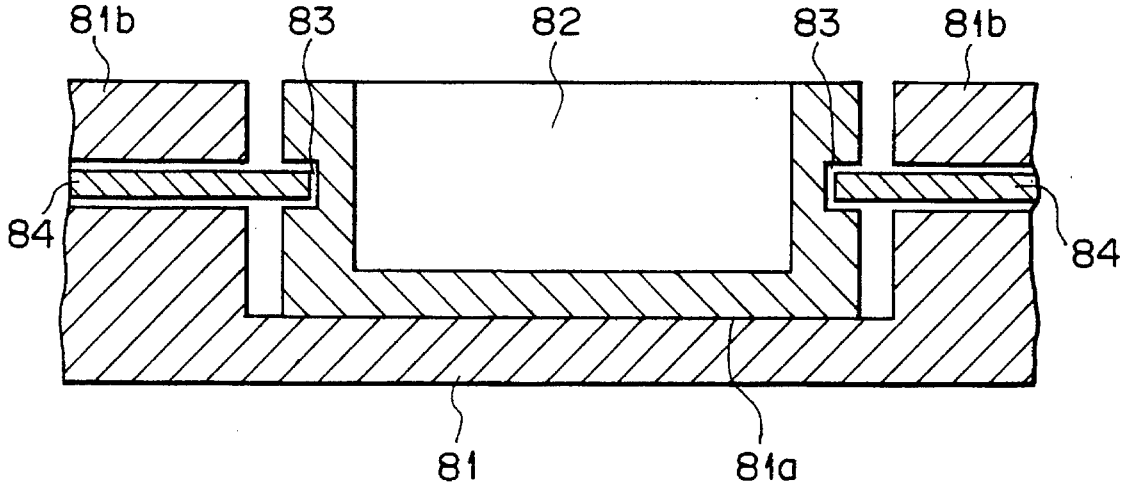
FIG. 11 is a fragmentary section showing the eighth embodiment in an attachment and detachment inhibiting condition.

As shown in FIG. 10, an operating section 80 has a body 81. A pair of locking members, or shutters, 84 are included in the body 81 and movable back and forth by being driven by an electromagnetic solenoid, not shown. The locking members 84 are respectively received in, among three contiguous walls **81*b* surrounding a unit mounting surface 81*a*, two longer walls 81*b*. Each locking member 84 is movable to above the unit mounting surface 81*a* out of the associated wall 81*b*. A unit 82 is formed with grooves 83 on opposite side walls thereof (where a connector is absent). The grooves 83 are aligned with the locking members 84 when the unit 82 is mounted to the body 81**.

In operation, after the unit 82 has been set on the body 81, a main switch, not shown, provided on the apparatus is turned on. Then, the solenoid, not shown, is energized to cause the locking members 84 to protrude to above the unit mounting surface **81*a* until the edges thereof mate with the grooves 83 of the unit 82. In this condition, the unit 82 cannot be removed from the body 81. Further, when the main switch is turned on before the unit 82 is set, the unit 82 is prevented from being mounted to the body 81. In this way, the embodiment prevents the unit 82 from being mounted to or dismounted from the body 81 while the main switch is turned on. If the unit 82 is mounted to or dismounted from the body 81** while the main switch is turned on, it is likely that the connectors are short-circuited to damage the circuitry.

Figure 12:
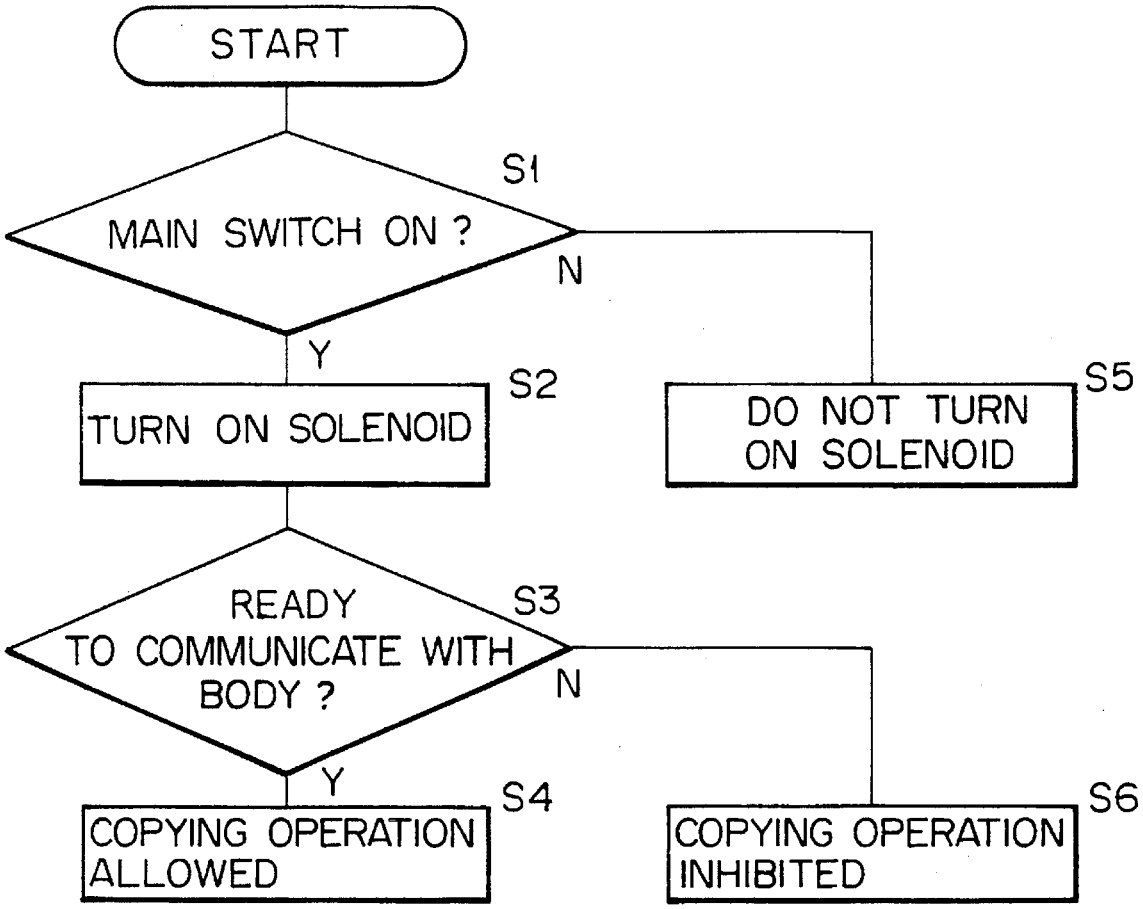
FIG. 12 is a flowchart demonstrating a procedure for controlling an attachment and detachment inhibiting mechanism included in the eighth embodiment as well as an image forming apparatus.

The control over the attachment and detachment preventing mechanism and the apparatus will be described with reference to FIG. 12. As shown, whether or not the main switch of the apparatus (copier) has been turned on is determined (step S1). If the main switch has not been turned on (N, step S1), the solenoid for driving the locking members 84 is not energized (step S5). If otherwise (Y, step S1), the solenoid is turned on to cause the locking members 84 to protrude (step S2). As a result, the unit 82 is prevented from being mounted to or dismounted from the body 81. Subsequently, whether or not the unit 82, as well as other units, can communicate with the apparatus body is determined (step S3). If the answer of the step S3 is positive, Y, a copying operation is allowed (step S4); if otherwise, N, a copying operation is inhibited (step S6).

In summary, it will be seen that the present invention provides an operating section for an image forming apparatus which has various unprecedented advantages, as enumerated below.

(1) Input keys are arranged on key units which are removable from the body of the operating section. Hence, when any one of the key units is smeared, damaged or the life thereof expires, the defective key unit should only be replaced alone. This allows the key units other than the defective unit to be continuously used.

(2) The operating section is removable from the body of the apparatus and, therefore, reusable.

(3) Since the input keys are classified on a function basis, they are easy to operate. Further, each unit can be efficiently used since the input keys comparable with each other as to the frequency of use share the same unit.

(4) Since the connectors of the units are identical in configuration, the units can be laid out in a desired manner.

(5) The units are easy to control since the kind of each unit is determined on the basis of the position of the connector.

(6) A particular ID code is given to each unit to allow the kind of the unit to be identified. This also promotes easy control over the units. Since a single connector should only be located at a single mounting position, the operating section can be produced at a minimum of cost. In addition, each unit can be controlled in matching relation to a change in the function thereof.

(7) Storing means is built in each key unit for storing input information, so that the user is free from troublesome manipulations. Further, when the body of the operating section is replaced, the user does not have to enter information all over again.

(8) Displaying means can be reused. It is possible to replace only the displaying means whose service life is limited.

(9) A touch panel, playing the role of displaying means and the role of inputting means at the same time, can be reused. It is also possible to replace only the touch panel whose life is limited.

(10) Displaying means and inputting means can be replaced with each other in position and, therefore, arranged in any desired manner.

(11) The units are inhibited from being mounted to or dismounted from the body while the main switch of the apparatus body is turned on. This prevents circuitry from being damaged by, for example, the short-circuit of connectors.

Various modifications will become possible for those skilled in the art after receiving the teachings of the present disclosure without departing from the scope thereof.

What is claimed is:

1. An operating section for an image forming apparatus, comprising:

a body; and at least one of key inputting means accessible for manually inputting key commands meant for said image forming apparatus, and display means for displaying statuses of said image forming apparatus and other necessary information;

said at least one of said key inputting means and said display means being at least partly constructed as a module which is removable from said body;

wherein said operating section is removably mounted on an apparatus body of said image forming apparatus.

2. An operating section as claimed in claim 1, wherein said key inputting means is constructed as a plurality of modules on a function basis.

3. An operating section as claimed in claim 2, wherein at least one of said modules comprises a touch panel.

4. An operating section as claimed in claim 2, wherein said modules are connected to said body by respective connecting means which have an identical configuration.

5. An operating section as claimed in claim 4, wherein said connecting means of said modules are different in position from each other, said body comprising a plurality of connecting means respectively corresponding to said connecting means of said modules at module mounting positions thereof, whereby any one of said modules is allowed to be mounted to any one of said module mounting positions.

6. An operating section as claimed in claim 4, wherein said modules are each given a particular identification code.

7. An operating section as claimed in claim 1, wherein said removable module comprises storing means for storing information entered on said inputting means.

8. An operating section as claimed in claim 1, wherein said display means is constructed into a module removably mounted on said body.

9. An operating section as claimed in claim 8, wherein said display means and said inputting means are each constructed into a module removably mounted on said body and are connectable to said body in a replaceable manner.

10. An operating section as claimed in claim 1, further comprising means for inhibiting said module from being mounted to or dismounted from said body while a current is fed to said image forming apparatus.

11. An operating section for an image forming apparatus, comprising:

a body; and at least one manually operated command input key, and a display which displays status of said image forming apparatus and other information;

said at least one said command input key and said display being at least partly constructed as a module which is removable from said body;

wherein said operating section is removably mounted on an apparatus body of said image forming apparatus.

12. An operating section according to claim 11, comprising plural of said command input keys constructed as a plurality of modules on a function basis.

13. An operating section according to claim 12, wherein at least one of said modules comprises a touch panel.

14. An operating section according to claim 12, wherein said modules are connected to said body by respective connectors which have an identical configuration.

15. An operating section according to claim 14, wherein said connectors of said modules are different in position from each other, said body comprising a plurality of connectors respectively corresponding to the connectors of said modules at module mounting positions thereof, whereby any one of said modules is allowed to be mounted to any one of said module mounting positions.

16. An operating section according to claim 14, wherein said modules are each given a particular identification code.

17. An operating section according to claim 11, wherein said removable module comprises a memory which stores information entered on the at least one command input key.

18. An operating section according to claim 11, wherein said display is constructed into a module removably mounted on said body.

19. An operating section according to claim 18, wherein said display and said at least one command input key are each constructed into a module removably mounted on said body and are connectable to said body in a replaceable manner.

20. An operating section according to claim 11, further comprising an inhibit element which inhibits said module from being mounted to or dismounted from said body while a current is fed to said image forming apparatus.

* * * * *